US011619094B1

(12) United States Patent
Alshaarawi et al.

(10) Patent No.: US 11,619,094 B1
(45) Date of Patent: Apr. 4, 2023

(54) SYSTEMS AND METHODS FOR EMPLOYING MULTIPLE DOWNHOLE DRILLING MOTORS

(71) Applicant: SAUDI ARABIAN OIL COMPANY, Dhahran (SA)

(72) Inventors: Amjad Alshaarawi, Khobar (SA); Abdulwahab Aljohar, Dhahran (SA); Jianhui Xu, Dhahran (SA); Guodong Zhan, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/456,280

(22) Filed: Nov. 23, 2021

(51) Int. Cl.
*E21B 4/02* (2006.01)
*E21B 4/00* (2006.01)
*E21B 4/16* (2006.01)

(52) U.S. Cl.
CPC ..... *E21B 4/02* (2013.01); *E21B 4/006* (2013.01); *E21B 4/16* (2013.01)

(58) Field of Classification Search
CPC ..... E21B 4/16; E21B 4/02
See application file for complete search history.

(56) References Cited

U.S. PATENT DOCUMENTS 4,011,917 A * 3/1977 Tiraspolsky ..... F04C 13/008 418/48
4,059,165 A * 11/1977 Clark ..... E21B 4/02 418/48
4,187,061 A * 2/1980 Jurgens ..... F04C 15/0042 418/153
4,585,401 A * 4/1986 Baldenko ..... F04C 2/1073 418/5
5,588,818 A * 12/1996 Houmand ..... F16D 1/0876 418/5
5,620,056 A * 4/1997 Eppink ..... E21B 4/02 175/107
6,571,888 B2 6/2003 Comeau et al.
10,358,903 B2 * 7/2019 Smith ..... E21B 3/00
2009/0183921 A1 7/2009 Gurjar et al.
2013/0175093 A1 * 7/2013 Taylor ..... E21B 4/02 175/57

FOREIGN PATENT DOCUMENTS

CN 112031739 A 12/2020

* cited by examiner

*Primary Examiner* — Robert E Fuller
(74) *Attorney, Agent, or Firm* — Osha Bergman Watanabe & Burton LLP

(57) ABSTRACT

A downhole drilling motor assembly includes a first motor, a second motor aligned coaxially with the first motor, and a clutch assembly aligned coaxially with the first and second motors. The clutch assembly independently and selectively actuates each of the first and second motors to rotationally drive a drill bit. A related method includes: mounting a drill bit at a distal end of a drill string at a well site; and providing a downhole drilling motor assembly which rotationally drives the drill bit. The clutch assembly is controlled to independently and selectively actuate the first and second motors, and the drill bit is rotationally driven via the independent and selective actuation of the first and second motors.

20 Claims, 5 Drawing Sheets

SYSTEMS AND METHODS FOR EMPLOYING MULTIPLE DOWNHOLE DRILLING MOTORS

BACKGROUND

Conventionally, downhole drilling motors are used frequently in oil and gas drilling operations. These motors convert available hydraulic energy into rotational energy at a drill bit. Such conversion happens in accordance with a given relationship between torque and RPM (revolutions per minute), depending on the design of the motor; this relationship is also referred to as a "torque-speed curve". As such, some motors are high-torque/low-speed, some are low-torque/high-speed, and others operate somewhere between these general endpoints. However, different motors are generally suitable for use in different operating contexts, and are often not well-suited individually for subsurface sections that are heterogeneous in nature.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a downhole drilling motor assembly including a first motor, a second motor aligned coaxially with the first motor, and a clutch assembly aligned coaxially with the first and second motors. The clutch assembly independently and selectively actuates each of the first and second motors to rotationally drive a drill bit.

In one aspect, embodiments disclosed herein relate to a method including: mounting a drill bit at a distal end of a drill string at a well site; and providing a downhole drilling motor assembly which rotationally drives the drill bit. The motor assembly includes a first motor, a second motor aligned coaxially with the first motor, and a clutch assembly aligned coaxially with the first and second motors. The clutch assembly is controlled to independently and selectively actuate the first and second motors. The drill bit is rotationally driven via the independent and selective actuation of the first and second motors.

In one aspect, embodiments disclosed herein relate to a bottom hole assembly including a drill bit and a downhole drilling motor assembly which rotationally drives the drill bit. The motor assembly includes a first motor, a second motor aligned coaxially with the first motor, and a clutch assembly aligned coaxially with the first and second motors. The clutch assembly independently and selectively actuates each of the first and second motors to rotationally drive the drill bit.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
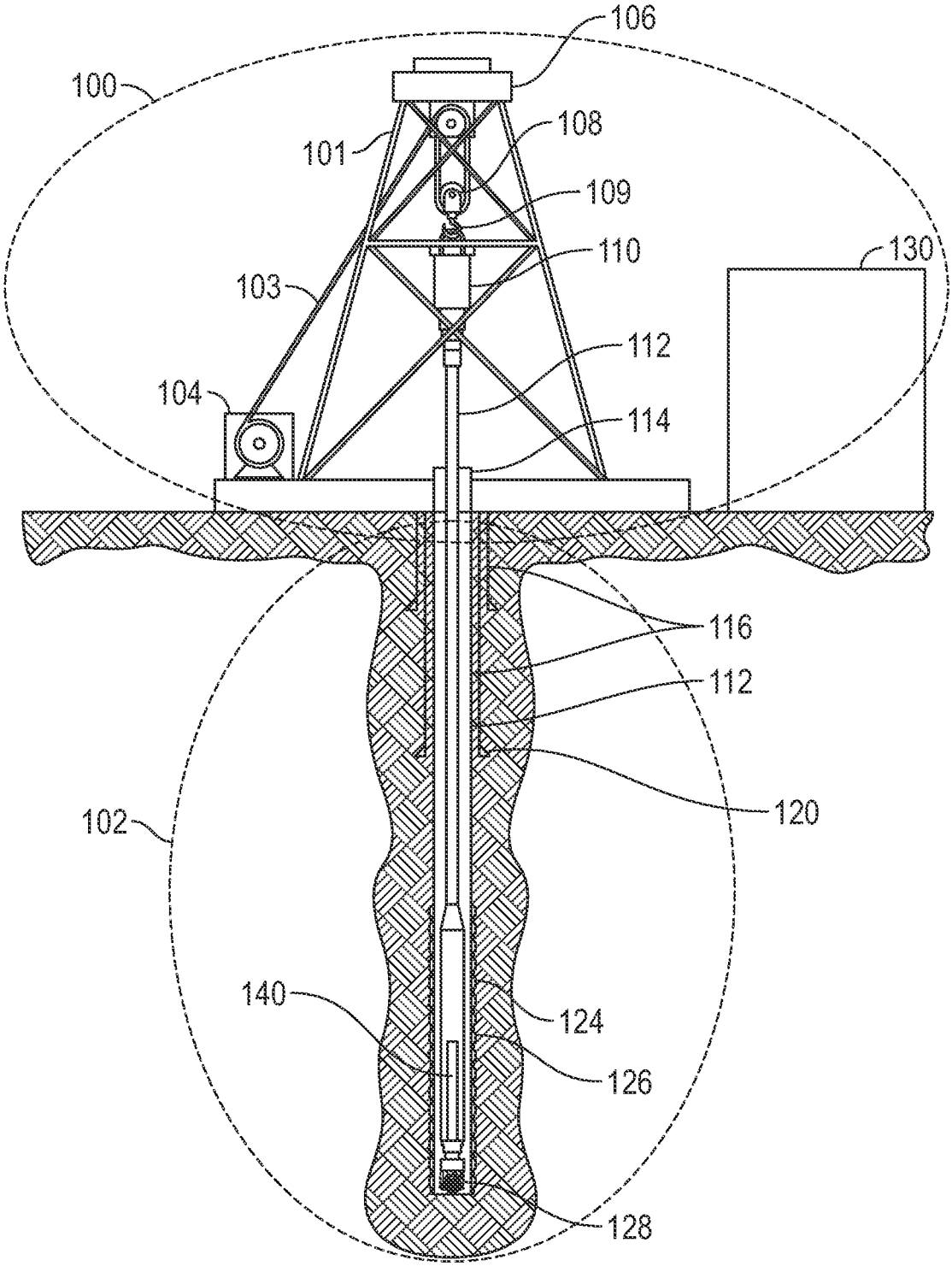
FIG. 1 schematically illustrates, in a cross-sectional elevational view, a conventional drilling rig and wellbore by way of general background and in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Generally, when drilling, several drill pipes are connected together at the surface/rig level to form a drill string, and the drill bit is installed at the lower end of the string. The bit is used to cut through subsurface formations by applying a combination of linear force and rotation. Rotation can delivered to the bit either by rotating the entire drill string from surface, or by using a tool to create rotation downhole, i.e., a drilling motor.

Drilling motors (also known as "mud motors") convert hydraulic power available downhole (via the pumping of the drilling fluid, or "mud") to rotational mechanical energy at the bit. This conversion happens at a fixed curve on a torque-RPM plane, depending on the design of the motor. As such, some motors will be high-torque/low-speed, others will be low-torque/high-speed, and others still will operate between these endpoints.

Conventionally, a drilling motor—and its associated torque-speed curve—is selected prior to drilling a specific subsurface section, based on characteristics of the expected rock formation. This means that a single torque-speed curve is fixed for drilling through the entire section. However, subsurface sections may at times be heterogeneous, such that the nature, structure or characteristics of rock layers (or formations) may change significantly over relatively short drilling distances. Typically, when this occurs, drilling motors are switched out wholesale to cater more closely to the characteristics of different layers and thus benefit from different torque-speed curves. However, the time and effort involved in pulling the drill string (and motor) out-of-hole, then running-in-hole again to deploy a replacement motor may prove to be prohibitive, or at least wholly impractical.

As such, in accordance with one or more embodiments, there is broadly contemplated herein a dual motor setup (e.g., two drilling motors aligned coaxially) and a clutch system disposed between the two motors. The two motors differ in their torque-speed curves (e.g., a high-speed/low-torque motor and a low-speed/high-torque motor), and the clutch system permits selectively switching between the two.

Turning now to the figures, to facilitate easier reference when describing FIGS. 1 through 5, reference numerals may be advanced by a multiple of 100 in indicating a similar or analogous component or element among FIGS. 1-5.

FIG. 1 schematically illustrates, in a cross-sectional elevational view, a conventional drilling rig and wellbore by way of general background and in accordance with one or more embodiments. As such, FIG. 1 illustrates a non-restrictive example of a well site 100. The well site 100 is depicted as being on land. In other examples, the well site 100 may be offshore, and drilling may be carried out with or without use of a marine riser. A drilling operation at well site 100 may include drilling a wellbore 102 into a subsurface including various formations 126. For the purpose of drilling a new section of wellbore 102, a drill string 112 is suspended within the wellbore 102. The drill string 112 may include one or more drill pipes connected to form conduit and a bottom hole assembly (BHA) 124 disposed at the distal end of the conduit. The BHA 124 may include a drill bit 128 to cut into the subsurface rock. The BHA 124 may include measurement tools, such as a measurement-while-drilling (MWD) tool or a logging-while-drilling (LWD) tool (not shown), as well as other drilling tools that are not specifically shown but would be understood to a person skilled in the art.

Additionally, by way of general background in accordance with one or more embodiments, the drill string 112 may be suspended in wellbore 102 by a derrick structure 101. A crown block 106 may be mounted at the top of the derrick structure 101. A traveling block 108 may hang down from the crown block 106 by means of a cable or drill line 103. One end of the drill line 103 may be connected to a drawworks 104, which is a reeling device that can be used to adjust the length of the drill line 103 so that the traveling block 108 may move up or down the derrick structure 101. The traveling block 108 may include a hook 109 on which a top drive 110 is supported. The top drive 110 is coupled to the top of the drill string 112 and is operable to rotate the drill string 112. Alternatively, the drill string 112 may be rotated by means of a rotary table (not shown) on the surface 114. Drilling fluid (commonly called mud) may be pumped from a mud system 130 into the drill string 112. The mud may flow into the drill string 112 through appropriate flow paths in the top drive 110 or through a rotary swivel if a rotary table is used (not shown).

Further, by way of general background in accordance with one or more embodiments, and during a drilling operation at the well site 100, the drill string 112 is rotated relative to the wellbore 102 and weight is applied to the drill bit 128 to enable the drill bit 128 to break rock as the drill string 112 is rotated. In some cases, the drill bit 128 may be rotated independently with a drilling motor 140. Generally, it is also possible to rotate the drill bit 128 using a combination of a drilling motor 140 and the top drive 110 (or a rotary swivel if a rotary table is used instead of a top drive) to rotate the drill string 112. While cutting rock with the drill bit 128, drilling fluid or "mud" (not shown) is pumped into the drill string 112. The mud flows down the drill string 112 and exits into the bottom of the wellbore 102 through nozzles in the drill bit 128. The mud in the wellbore 102 then flows back up to the surface 114 in an annular space between the drill string 112 and the wellbore 102 carrying entrained cuttings to the surface 114. The mud with the cuttings is returned to the mud system 130 to be circulated back again into the drill string 112. Typically, the cuttings are removed from the mud, and the mud is reconditioned as necessary, before pumping the mud again into the drill string 112.

Moreover, by way of general background in accordance with one or more embodiments, drilling operations are completed upon the retrieval of the drill string 112, the BHA 124, and the drill bit 128 from the wellbore 102. In some embodiments of wellbore 102 construction, production casing operations may commence. A casing string 116, which is made up of one or more larger diameter tubulars that have a larger inner diameter than the drill string 112 but a smaller outer diameter than the wellbore 102, is lowered into the wellbore 102 on the drill string 112. Generally, the casing string 116 is designed to isolate the internal diameter of the wellbore 102 from the adjacent formation 126. Once the casing string 116 is in position, it is set and cement is typically pumped down through the internal space of the casing string 116, out of the bottom of the casing shoe 120, and into the annular space between the wellbore 102 and the outer diameter of the casing string 116. This secures the casing string 116 in place and creates the desired isolation between the wellbore 102 and the formation 126. At this point, drilling of the next section of the wellbore 102 may commence.

The disclosure now turns to working examples of a downhole drilling motor assembly in accordance with one or more embodiments, as described and illustrated with respect to FIGS. 2-5. It should be understood and appreciated that these merely represent illustrative examples, and that a great variety of possible implementations are conceivable within the scope of embodiments as broadly contemplated herein.

Figure 2:
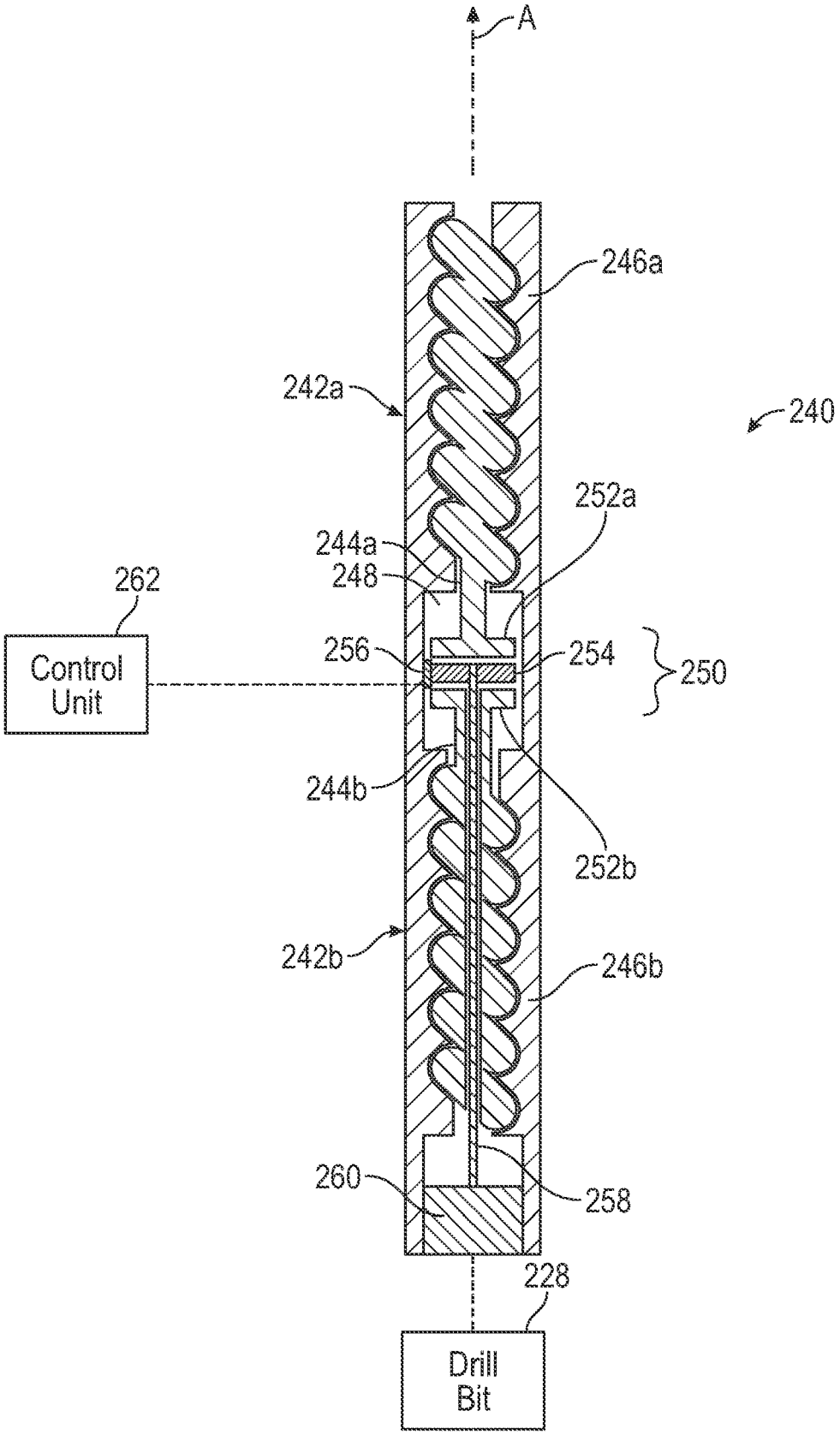
FIG. 2 schematically illustrates, in cross-sectional elevational view, a dual-motor assembly in accordance with one or more embodiments.

FIG. 2 schematically illustrates, in cross-sectional elevational view, a dual-motor assembly 240 in accordance with one or more embodiments. Dual-motor assembly 240 may form a portion of a bottom-hole assembly (BHA) such as that indicated at 124 in FIG. 1, for the purpose of rotationally driving a drill bit 228 (e g, similar to that indicated at 128 in FIG. 1). As such, dual-motor assembly 240 includes a first motor 242*a* and a second motor 242*b* are aligned coaxially with respect to one another, along a longitudinal axis A which is oriented along a general longitudinal direction of the BHA. In the present working example, each of the motors 242*a* and 242*b* is formed from a rotor (244*a* and 244*b*, respectively) which is nested within, is at least partly coaxial with, and freely undergoes rotational displacement with respect to a stator (246*a* and 246*b*, respectively).

In accordance with one or more embodiments, each of the stators 246*a/b* thus essentially forms a housing within which each of the rotors 244*a/b*, respectively, undergoes rotational displacement. Coaxial alignment of the motors 242*a* and 242*b* with respect to one another can be understood in the sense of: a central longitudinal axis defined by at least a portion of rotor 244*a* or of stator 246*a* being aligned coaxially with a central longitudinal axis defined by at least a portion of rotor 244*b* or stator 246*b*. Generally, the components of motors 242*a/b* as shown in FIG. 2 are depicted in a schematic and stylized manner and are not necessarily drawn to scale, and thus are shown in such a manner for mainly illustrative purposes. It should be appreciated that a great variety of drilling motors and constituent components can be employed within the general scope of features discussed and broadly contemplated herein, especially in connection with the features discussed below with respect to FIGS. 2-4.

Figure 3:
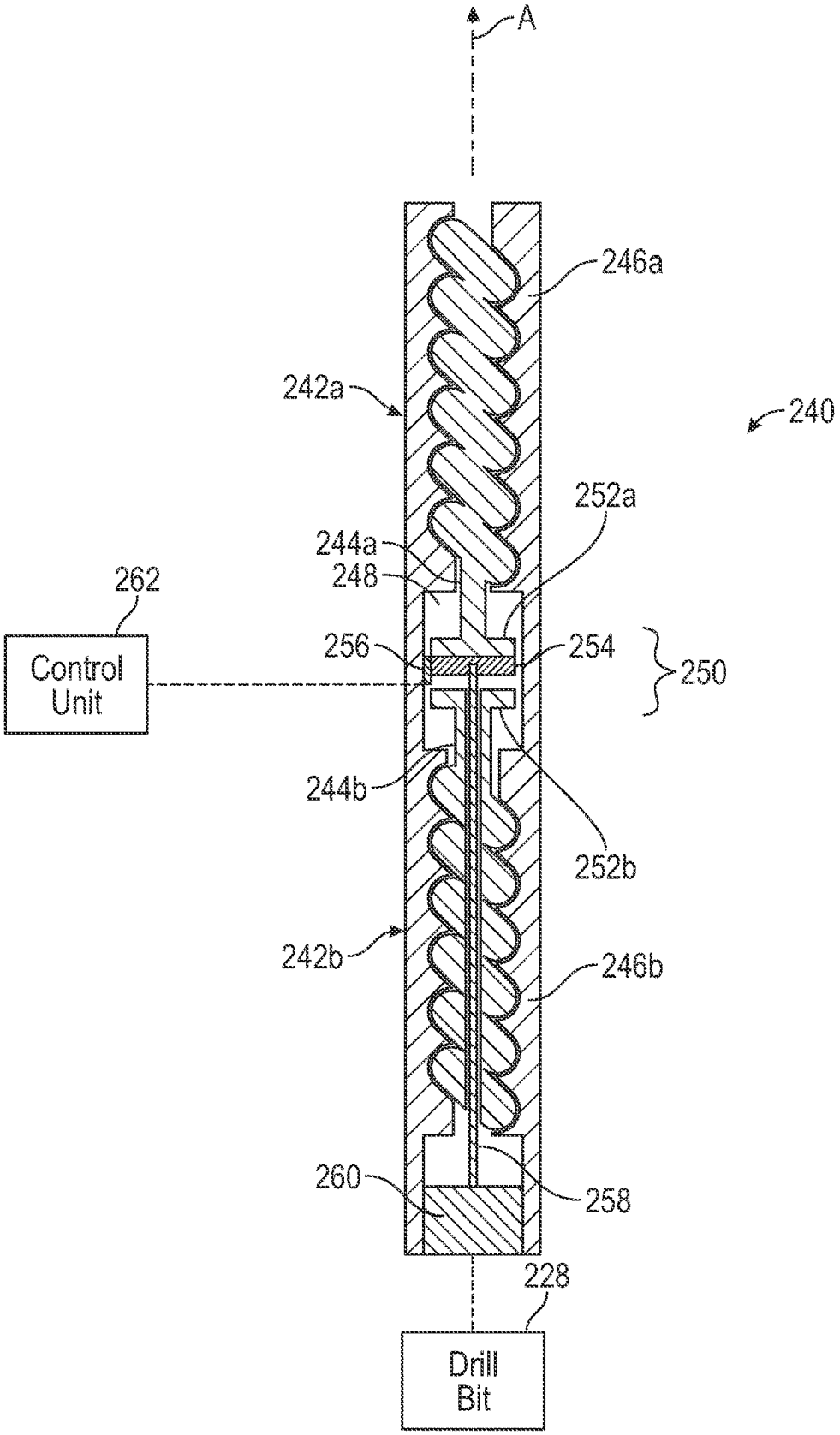
FIG. 3 provides essentially the same view as FIG. 2 and shows an engagement disk in a first engagement position, in accordance with one or more embodiments.
Figure 4:
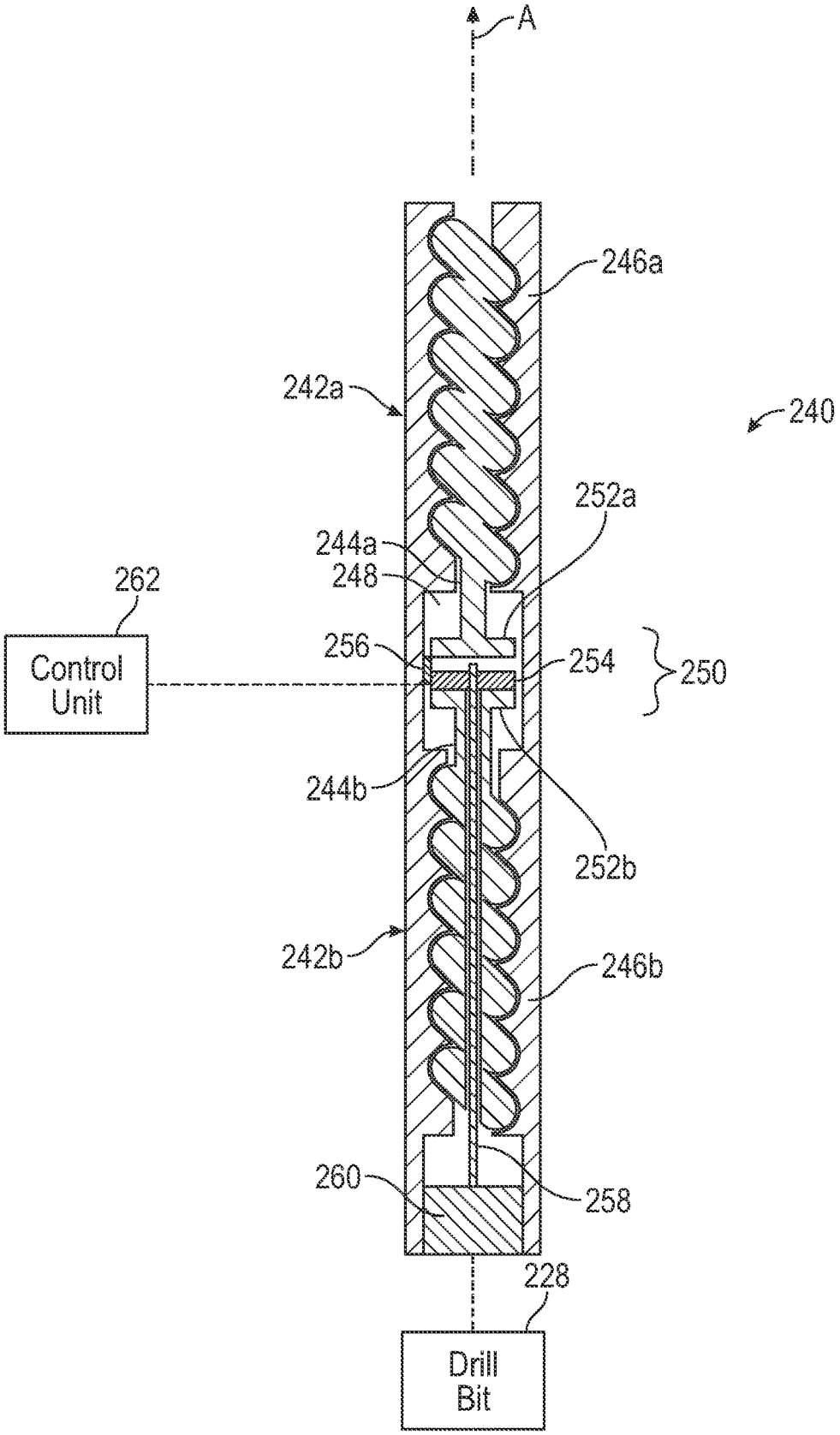
FIG. 4 provides essentially the same view as FIGS. 2 and 3, and shows an engagement disk in a second engagement position, in accordance with one or more embodiments.

In accordance with one or more embodiments, a clutch chamber 248 may be disposed axially between the two motors 242*a* and 242*b*, and houses components of a clutch 250. In the present working example, the clutch 250 includes three coaxially aligned components: a first disk 252*a*, as a terminal portion of the rotor 244*a* of first motor 242*a*; a second disk 252*b*, as a terminal portion of the rotor 244*b* of second motor 242*b*; and an engagement disk 254 disposed between first disk 252*a* and second disk 252*b*. Thus, the first disk 252*a* is disposed at a free end of the (first) rotor 244*a* and the second disk 252*b* is disposed at a free end of the (second) rotor 244*b*. Also shown is an actuator 256, which can effect selective axial displacement of the engagement disk 254 into three different positions: a neutral position (shown), where there is no contact with either of the disks 252*a* and 252*b* (thus where the engagement disk 254 does not engage the first motor 242*a* or the second motor 242*b*); a first engagement position (upwardly in the figure), where the engagement disk 254 is in full operational contact (i.e., face contact) with first disk 252*a*; and a second engagement position (downwardly in the figure), where the engagement disk 254 is in full operational contact (i.e., face contact) with second disk 252*b*. FIG. 3 provides essentially the same view as FIG. 2 and shows the engagement disk 254 in the first engagement position, while FIG. 4 provides essentially the same view as FIGS. 2 and 3, and shows the engagement disk in the second engagement position. Continued reference may be made to all of FIGS. 2-4 collectively.

In accordance with one or more embodiments, a primary shaft 258 may extend from the engagement disk 254 to a mandrel 260 which itself rotationally drives the drill bit 228; thus, the primary shaft 258 drivingly interconnects the engagement disk 254 and the mandrel 260. The primary shaft 258 may be nested coaxially within the rotor 244*b* of second motor 242*b* (e.g., within a dedicated cylindrical chamber) such that it will be rotationally driven, itself, via the first motor 242*a* when the engagement disk 254 is in the first engagement position (as shown in FIG. 3), or via second motor 242*b* when the engagement disk 254 is in the second engagement position (as shown in FIG. 4). When driven via the second motor 242*b* as shown in FIG. 4, the primary shaft 258 actually rotates (or undergoes rotational displacement) in tandem with the rotor 244*b*. When driven via the first motor 242*a* as shown in FIG. 3, the primary shaft 258 freely rotates (or undergoes rotational displacement) with respect to an essentially stationary rotor 244*b*.

In accordance with one or more embodiments, the actuator may assume any of a great variety of forms, including a hydraulic piston, electric piston, or electric motor. A suitable control unit 262 is provided to control the actuator 256 and may be disposed at the surface; e.g., it can send pressure pulses, or send signals via electric wiring. A suitable downhole receiver may be included, closer in proximity to the actuator 256, to receive the pressure pulses or signals and relay the same to the actuator 256. The control unit 262 may be directly controlled by a user at the surface, or alternatively may respond to changes in flowrate of the pumped drilling fluid. In one or more variant examples, the control unit 262 may be housed in the BHA (e.g., axially adjacent to the motor assembly 240 and in a direction away from the drill bit 228).

As such, in accordance with one or more embodiments, the actuator 256 serves to move the engagement disk 254 selectively into either of the first and second engagement positions (as shown in FIGS. 3 and 4, respectively), and (when prompted by the control unit 262) back to the neutral position (as shown in FIG. 2). The engagement disk 254, for its part, may be slidably mounted on the primary shaft 258 while still held rigid with respect to the same in rotational movement (e.g., via an axial keyway). Further, the clutch 250 may generally operate as an electromagnetic clutch, e.g., such that engagement disk 254 may engage in face contact with either of the first and second disks 252*a/b* magnetically, thus permitting torque transmission between each respective rotor 244*a/b* and the engagement disk 254.

Generally, it can be appreciated that in accordance with one or more embodiments as broadly contemplated herein, there are two commonly housed, separate motors which differ in their torque-speed curves and which each can be actuated independently and selectively. The selective actuation may be undertaken via a clutch assembly aligned coaxially with, and between, two motors. A primary shaft may extend from a clutch engagement disk and may be nested coaxially within the rotor of a distal motor (such as motor 246*b* shown in FIGS. 2-4), in turn rotationally driving the mandrel and a drill bit.

Figure 5:
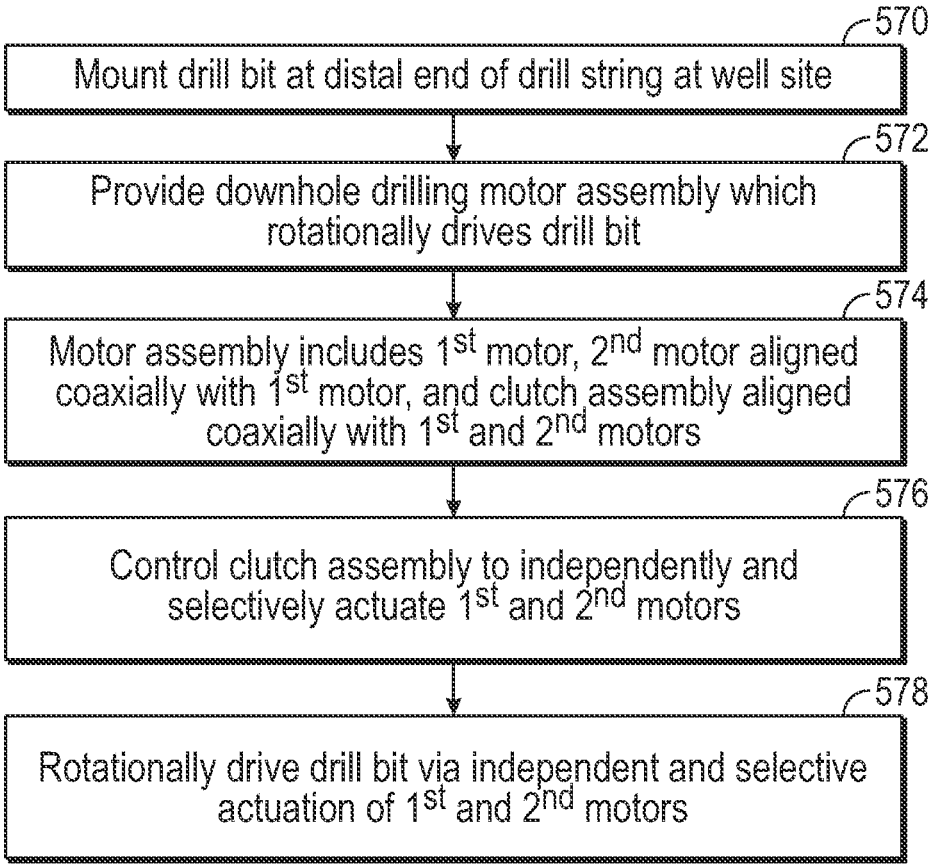
FIG. 5 shows a flowchart of a method in accordance with one or more embodiments.

FIG. 5 shows a flowchart of a method, as a general overview of steps which may be carried out in accordance with one or more embodiments described or contemplated herein.

As such, in accordance with one or more embodiments, a drill bit is mounted at a distal end of a drill string at a well site (570). This can correspond to the drill bit indicated at 128 in FIG. 1 or at 228 in FIGS. 2-4, along with the drill string indicated at 112 in FIG. 1. A downhole drilling motor assembly is provided which rotationally drives the drill bit (572). Also, the motor assembly includes a first motor, a second motor aligned coaxially with the first motor; and a clutch assembly aligned coaxially with the first and second motors (574). This can correspond to the motor assembly 240 and constituent components described and illustrated with respect to FIGS. 2-4. The clutch assembly is controlled to independently and selectively actuate the first and second motors (576). The drill bit is rotationally driven via the independent and selective actuation of the first and second motors (578). These steps can also be understood, by way of illustrative example, with relation to the clutch assembly 250 described and illustrated with respect to FIGS. 2-4, including the actuator 256 and its action to engage the motors 242*a* and 242*b*.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A downhole drilling motor assembly comprising:
a first motor;
a second motor aligned coaxially with the first motor; and
a clutch assembly aligned coaxially with the first and second motors;
wherein the clutch assembly independently and selectively actuates each of the first and second motors to rotationally drive a drill bit.

2. The motor assembly according to claim 1, wherein:
each of the first and second motors is associated with a torque-speed curve; and
the torque-speed curves of the first and second motors are different.

3. The motor assembly according to claim 1, wherein the clutch assembly is disposed between the first and second motors.

4. The motor assembly according to claim 1, wherein the clutch assembly includes an engagement disk which is selectively engageable with each of the first and second motors.

5. The motor assembly according to claim 4, wherein the engagement disk is axially displaceable between:
a first engagement position, where the engagement disk engages the first motor; and
a second engagement position, where the engagement disk engages the second motor.

6. The motor assembly according to claim 5, wherein:
the engagement disk additionally is axially displaceable to a neutral position, where the engagement disk does not engage the first motor or the second motor; and
the neutral position is between the first engagement position and the second engagement position.

7. The motor assembly according to claim 5, wherein:
the first motor includes a first rotor and a first disk disposed at a free end of the first rotor; and
the second motor includes a second rotor and a second disk disposed at a free end of the second rotor;
the engagement disk being in face contact with the first disk when in the first engagement position; and
the engagement disk being in face contact with the second disk when in the second engagement position.

8. The motor assembly according to claim 5, wherein the clutch assembly further includes an actuator which axially displaces the engagement disk between the first and second engagement positions.

9. The motor assembly according to claim 4, wherein the clutch assembly includes a primary shaft which extends from the engagement disk and rotationally drives the drill bit.

10. The motor assembly according to claim 9, further comprising:
a mandrel which directly rotationally drives the drill bit;
wherein the primary shaft drivingly interconnects the engagement disk and the mandrel.

11. The motor assembly according to claim 9, wherein:
the second motor comprises a rotor and a stator;
the rotor comprising a rotatable component nested within the stator; and
the primary shaft extends through, and is nested within, the stator.

12. A method comprising:
mounting a drill bit at a distal end of a drill string at a well site;
providing a downhole drilling motor assembly which rotationally drives the drill bit, the motor assembly comprising:
a first motor;
a second motor aligned coaxially with the first motor; and
a clutch assembly aligned coaxially with the first and second motors;
controlling the clutch assembly to independently and selectively actuate the first and second motors; and
rotationally driving the drill bit via the independent and selective actuation of the first and second motors.

13. The method according to claim 12, wherein:
each of the first and second motors is associated with a torque-speed curve; and
the torque-speed curves of the first and second motors are different.

14. The method according to claim 12, wherein the clutch assembly is disposed between the first and second motors.

15. The method according to claim 12, wherein:
the clutch assembly includes an engagement disk which is selectively engageable with each of the first and second motors; and
controlling the clutch assembly includes selectively engaging the engagement disk with each of the first and second motors.

16. The method according to claim 15, wherein selectively engaging the engagement disk comprises axially displacing the engagement disk between:
a first engagement position, where the engagement disk engages the first motor; and
a second engagement position, where the engagement disk engages the second motor.

17. The method according to claim 16, wherein:
controlling the clutch assembly further includes axially displacing the engagement disk to a neutral position, where the engagement disk does not engage the first motor or the second motor; and
the neutral position is between the first engagement position and the second engagement position.

18. The method according to claim 15, wherein:
the clutch assembly includes a primary shaft which extends from the engagement disk; and
rotationally driving the drill bit comprises driving the drill bit via the primary shaft.

19. The method according to claim 18, wherein:
the second motor comprises a rotor and a stator, the rotor comprising a rotatable component nested within the stator;
the primary shaft extends through, and is nested within, the stator; and
rotationally driving the drill bit comprises rotating the stator and primary shaft together.

20. A bottom hole assembly comprising:
a drill bit;
a downhole drilling motor assembly which rotationally drives the drill bit, the motor assembly comprising:
a first motor;
a second motor aligned coaxially with the first motor; and
a clutch assembly aligned coaxially with the first and second motors;
wherein the clutch assembly independently and selectively actuates each of the first and second motors to rotationally drive the drill bit.

* * * * *